US006364314B1

(12) United States Patent
Canterbury

(10) Patent No.: US 6,364,314 B1
(45) Date of Patent: Apr. 2, 2002

(54) MULTI-PLAYER GAMING PLATFORM ALLOWING INDEPENDENT PLAY ON COMMON VISUAL DISPLAY

(75) Inventor: Stephen A. Canterbury, Antioch, IL (US)

(73) Assignee: WMS Gaming Inc., Chicago, IL (US)

( * ) Notice: Subject to any disclaimer, the term of this patent is extended or adjusted under 35 U.S.C. 154(b) by 0 days.

(21) Appl. No.: 09/660,327

(22) Filed: Sep. 12, 2000

(51) Int. Cl.[7] ..... A63F 5/00
(52) U.S. Cl. ..... 273/274; 273/141 A; 463/16
(58) Field of Search ..... 273/138.1, 138.2, 273/139, 141 A, 274, 256, 278; 463/9–13, 16, 17, 25

(56) References Cited

U.S. PATENT DOCUMENTS 2,069,134 A * 1/1937 Collins et al.
3,834,711 A * 9/1974 Breslow
4,614,342 A * 9/1986 Takashima
4,738,451 A 4/1988 Logg
5,159,549 A * 10/1992 Hallman, Jr. et al.
5,588,650 A * 12/1996 Eman et al.
5,770,533 A * 6/1998 Franchi
5,857,909 A 1/1999 Rubin
5,857,910 A * 1/1999 Watanabe et al.
5,984,779 A * 11/1999 Bridgeman et al.
6,080,061 A * 6/2000 Watanabe et al.
6,102,403 A * 8/2000 Kaufman
6,164,651 A * 12/2000 Webb
6,186,505 B1 * 2/2001 Perrie et al.

* cited by examiner

*Primary Examiner*—William M. Pierce
(74) *Attorney, Agent, or Firm*—Jenkens & Gilchrist

(57) ABSTRACT

A multi-player gaming platform includes a large visual display and a plurality of player terminals coupled to the visual display. The visual display indicates a game of chance including a single play field and a plurality of movable game pieces. The game pieces are associated with the respective player terminals. In response to a wager placed at one of the player terminals, the game piece associated with that terminal moves along or near the play field and generates a game outcome. The game outcome may be defined by the game piece itself or where the game piece lands on the play field. The game awards a payoff if the game outcome meets winning criteria. The wager placed at the one of the player terminals is independent of any other wagers placed at the other player terminals and is independent of when the other wagers are placed. Similarly, the game piece associated with the one of the player terminals operates independent of the game pieces associated with the other player terminals. There is no actual player-to-player interaction—the players merely make use of the same play field. Therefore, the gaming platform allows players to join the game of chance at any time and to place wagers, make any necessary selections, and play the game at their own pace.

15 Claims, 3 Drawing Sheets

MULTI-PLAYER GAMING PLATFORM ALLOWING INDEPENDENT PLAY ON COMMON VISUAL DISPLAY

FIELD OF THE INVENTION

The present invention relates generally to multi-player gaming machine and, more particularly, to a gaming platform that allows multiple players to independently play a game of chance on a common visual display.

BACKGROUND OF THE INVENTION

Current multi-player gaming platforms for games of chance such as roulette, horse racing, keno, and bingo require all players to place their wagers and make selections by a specified time or event. Therefore, players can only join the game at certain times and must play the game at a predetermined pace that is either too slow or fast.

SUMMARY OF THE INVENTION

To overcome these shortcomings, the present invention provides a gaming platform including a large visual display and a plurality of player terminals coupled to the visual display. The visual display indicates a game of chance including a single play field and a plurality of movable game pieces. The game pieces are associated with the respective player terminals. In response to a wager placed at one of the player terminals, the game piece associated with that terminal moves along or near the play field and generates a game outcome. The game outcome may be defined by the game piece itself or where the game piece lands on the play field. The game awards a payoff if the game outcome meets winning criteria.

The wager placed at the one of the player terminals is independent of any other wagers placed at the other player terminals and is independent of when the other wagers are placed. Similarly, the game piece associated with the one of the player terminals operates independent of the game pieces associated with the other player terminals. There is no actual player-to-player interaction—the players merely make use of the same play field. Therefore, the gaming platform allows players to join the game of chance at any time and to place wagers, make any necessary selections, and play the game at their own pace. Because players do not have to wait to join the game, the game can be played more quickly and therefore can generate greater profits than existing multi-player gaming platforms.

BRIEF DESCRIPTION OF THE DRAWINGS

The foregoing and other advantages of the invention will become apparent upon reading the following detailed description and upon reference to the drawings in which.

Figure 1:
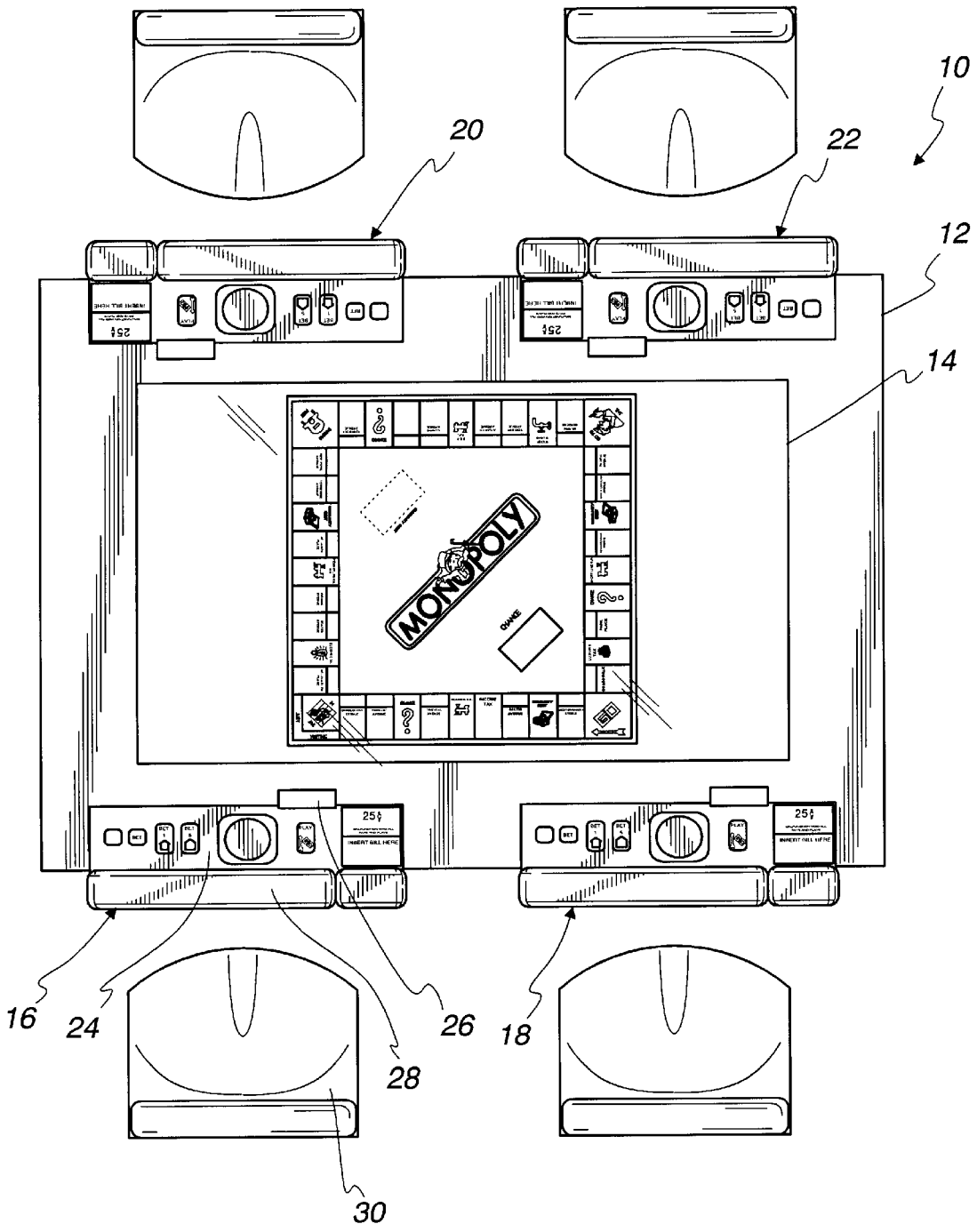
FIG. 1 is a top view of a multi-player gaming platform embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings, FIG. 1 depicts a multi-player gaming platform 10 embodying the present invention. The gaming platform 10 includes a cabinet 12, a large visual display 14, and a plurality of player terminals 16, 18, 20, and 22. The cabinet 12 houses a single game control system that receives inputs from the player terminals and executes a game of chance on the visual display 14. The visual display 14 is preferably a video display such as a CRT, LCD, or plasma display and is most preferably a plasma display. The plasma display is mounted to an upper side of the cabinet 12, oriented generally parallel to a ground surface, and covered by non-glare plexiglass. In one embodiment, the cabinet 12 has a length of approximately 56 inches, a width of approximately 38 inches, and a height (see FIG. 2) of approximately 30 inches. The plasma display 14 has a size of about 50 inches along the diagonal and a dot pitch of 1365×768 pixels.

Each of the player terminals 16, 18, 20, and 22 includes a player interface panel 24, a coin entry slot 26, and a cushioned bolster 28 for player comfort. A player may stand at one of the terminals or sit on an associated stool 30. The player interface panel 24 is preferably interchangeable with alternative interface panels to accommodate different games of chance that may be executed on the visual display 14. The coin entry slot 26 is located "behind" the player interface panel and slightly to the right of center. In one embodiment, the player interface panel 24 at each terminal is replaced with, or supplemented by, a respective small touchscreen. The touchscreen could be used to perform some or all of the input functions implemented with player interface panel 24.

Figure 2:
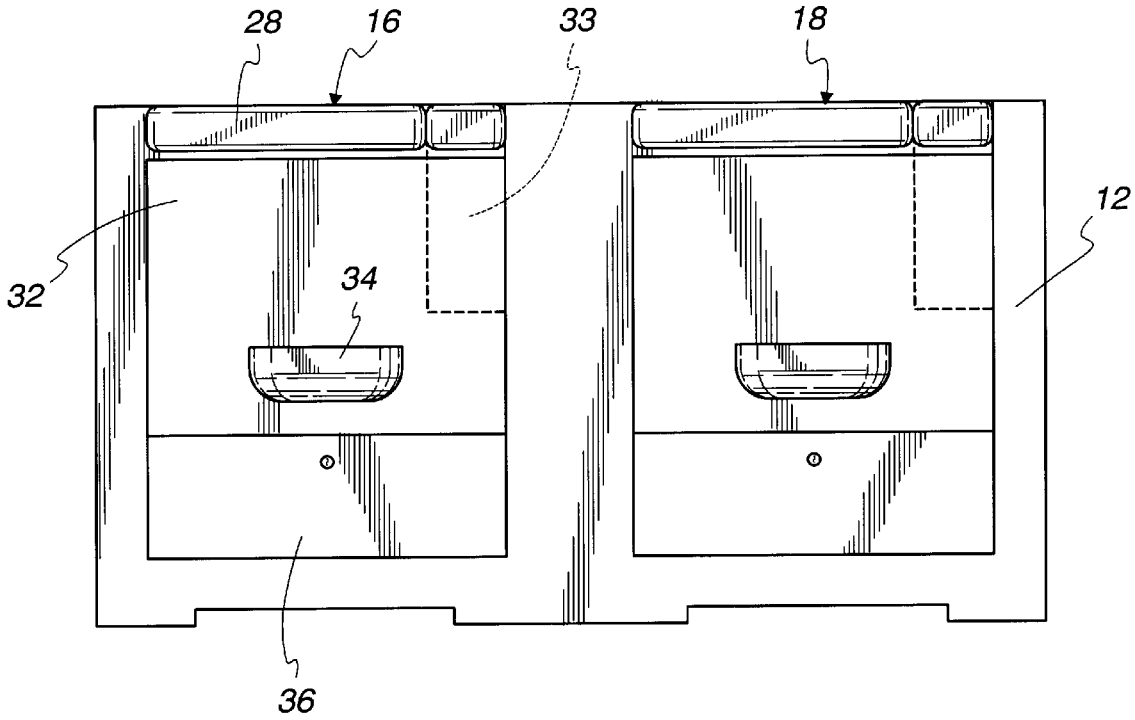
FIG. 2 is a side view of the gaming platform.

FIG. 2 is a side view of the gaming platform taken from a side having the player terminals 16 and 18. The opposing side having the player terminals 20 and 22 is identical in appearance. Each player terminal includes a respective currency access panel 32, coin tray 34, and drop box door 36. The currency access panel 32 is normally locked in a closed position but, when unlocked and opened by service personnel, provides easy access to a coin hopper, bill acceptor 33, and coin mechanism inside the cabinet 12. The dashed lines in FIG. 2 indicate the location of the bill acceptor 33. The bill acceptor 33 includes a bill entry slot approximately at the same height as the bolster 28. To facilitate opening the currency access panel 32, the access panel 32 may be either hinged to the cabinet 12 or fully removable therefrom. A player may collects any accumulated credits as coins discharged from the interior hopper into the coin tray 34. The coin tray 34 is attached to the access panel 32 and is optionally recessed into the access panel 32 to provide more knee room for the player. The drop box door 36 is hinged to the cabinet 12 and, when unlocked and opened by service personnel, provides easy access to the "drop," i.e., coins to be collected by the gaming establishment.

The opposing gaming platform sides, each of which includes a pair of the player terminals, are bridged by a pair of opposing ends. One of these two ends preferably includes a small unlockable door providing access to the game control system. The game control system may, for example, comprise a plurality of printed circuit boards including a PC-based main board and a plurality of distributed control boards at the respective player terminals. The control board at each player terminal is located inside the cabinet 12 next to the player interface panel 24, and is serially linked to the main central board by a bi-directional serial link such as a universal serial bus (USB). Both the control board and the main board include respective serial ports connected to opposite ends of the serial link.

The functions performed by the main board and the plurality of distributed control boards may be divided such that the main board performs high-level tasks while the control boards perform low-level tasks. Because the control boards assume the low-level tasks, the main board is free to provide enhanced performance for the high-level tasks. The PC-based main board carries a central processing unit (CPU) and system memory. The system memory, which may be implemented with such memory structures as read-only memory and battery-backed random-access memory, stores game software, operational instructions, and data associated with the gaming platform. The control board at each player terminal monitors the keys of the player interface panel 24, the condition (open or closed) of the currency access panel 32 and drop box door 36, and the entry of money into either the coin mechanism or bill acceptor. The control board reports any activity at these components to the CPU over the connecting serial link. The control board is also coupled to the coin hopper to control the discharge of coins into the coin tray 34.

Figure 3:
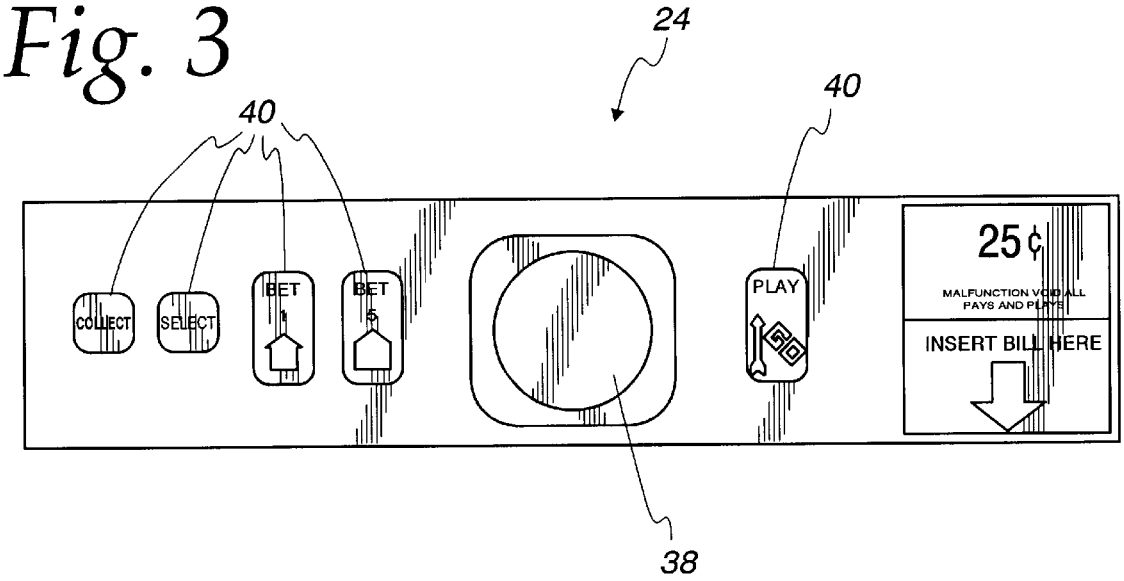
FIG. 3 is a top view of one of the player interface panels of the gaming platform.

FIG. 3 is a top view of one of the player interface panels 24 of the gaming platform. The illustrated player interface panel 24 includes a trackball 38 and five push-buttons 40 labeled COLLECT, SELECT, BET 1, BET 5, and PLAY/GO. The BET 1 and BET 5 push-buttons are used to place wagers. Each press of the BET 1 push-button generates a wager of one betting unit (one credit) up to a maximum of five betting units. Pressing the BET 5 push-button once generates the maximum wager of five betting units. The trackball 38 is generally centered for ease of use by a left-handed or right-handed player. The right portion of the player interface panel 24 includes an informational area directly above the bill acceptor 33 (see FIG. 2). This informational area may provide graphics identifying the location of the bill entry slot and the denomination required to play the game.

Figure 4:
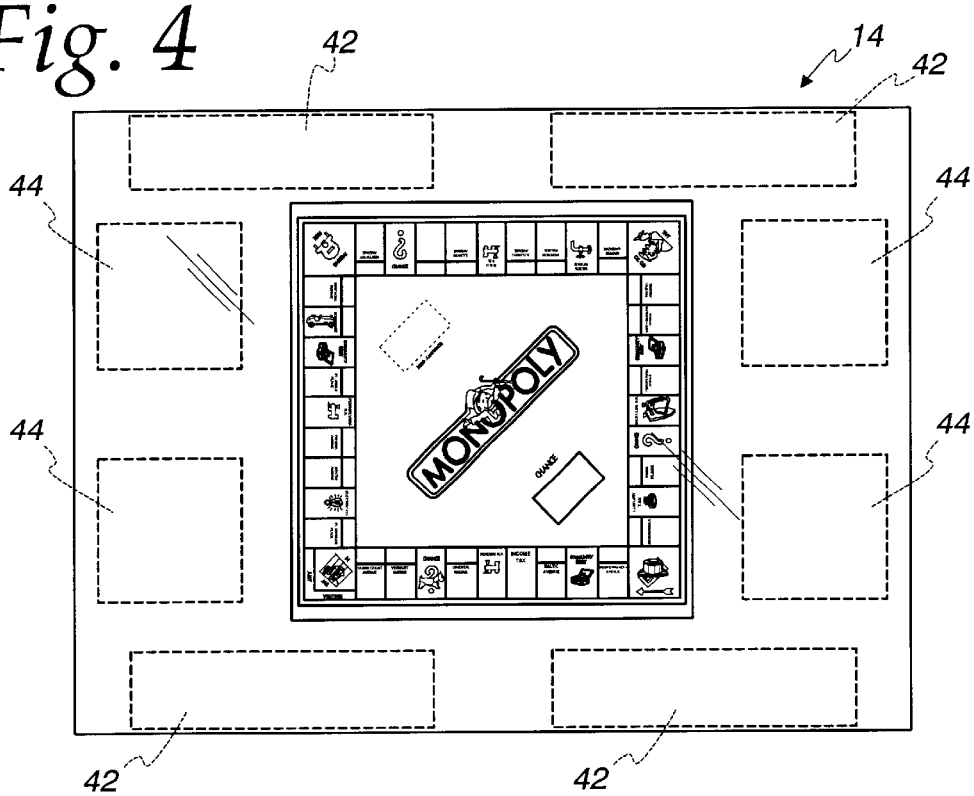
FIG. 4 is a top view of a visual display of the gaming platform showing a roulette-type game based on Monopoly.
Figure 5:
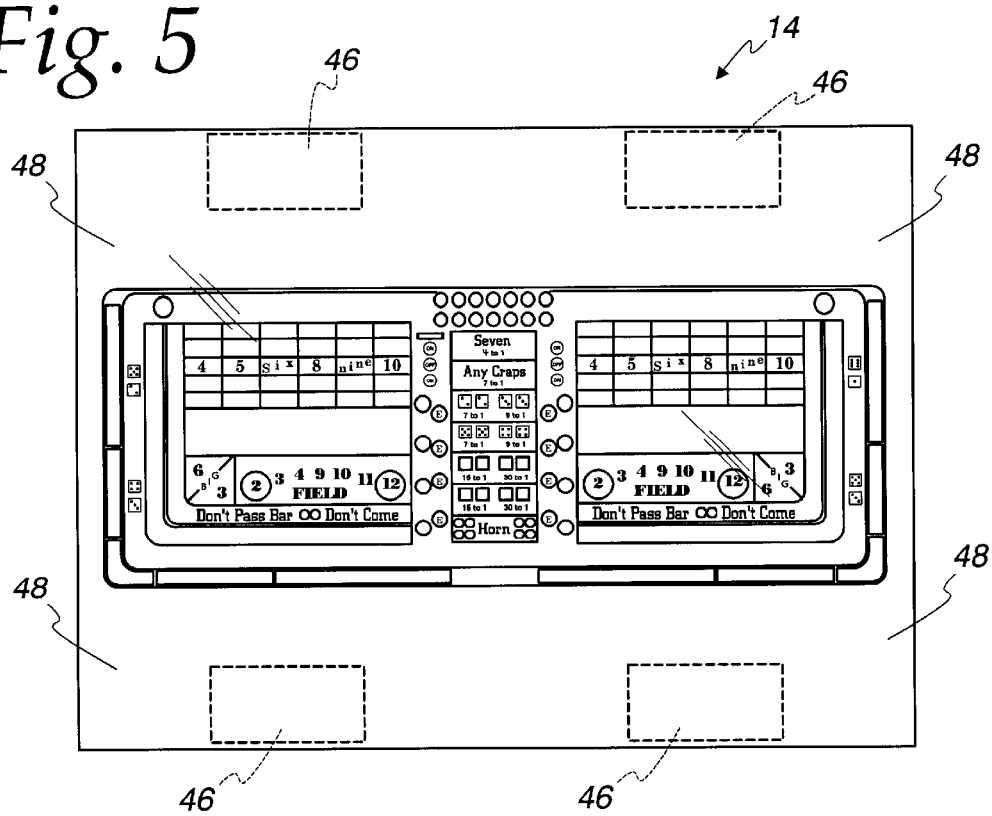
FIG. 5 is a top view of the visual display showing a game of craps.

Referring to FIGS. 4 and 5, the visual display 14 depicts a game of chance including a single play field and a plurality of movable game pieces. The game pieces are associated with the respective player terminals. In response to a wager placed at one of the player terminals using the BET 1 or BET 5 push-buttons (see FIG. 3) and pressing the PLAY/GO push-button (see FIG. 3), the game piece associated with that terminal moves along or near the play field and generates a game outcome. The game outcome may be defined by the game piece itself or where the game piece lands on the play field. The game awards a payoff if the game outcome meets winning criteria. The player may collect the payoff from the coin tray using the COLLECT push-button (see FIG. 3).

The wager placed at one player terminal is independent of any other wagers placed at the other player terminals and is independent of when the other wagers are placed. Similarly, the game piece associated with one player terminal operates independent of the game pieces associated with the other player terminals. There is no actual player-to-player interaction—the players merely make use of the same play field. Therefore, the gaming platform allows players to join the game of chance at any time and to place wagers, make any necessary selections, and play the game at their own pace. Because players do not have to wait to join the game, the game can be played more quickly and therefore can generate greater profits than existing multiplayer gaming platforms.

In the embodiment depicted in FIG. 4, the visual display 14 depicts a play field in the form of a large Monopoly board. The Monopoly board is generally located in the center of the visual display 14. First remaining areas 42 of the visual display 14 outside the Monopoly board and proximate to each player terminal may be used to display credits, bet, total bet, and paid information for each player. Second remaining areas 44 of the visual display 14 outside the Monopoly board may then be separated into four distinct areas, one for each player terminal, which may be used to facilitate and enhance game play. For example, the second remaining areas 44 may be used for placement of certain types of bets, showing odds, displaying payoffs, showing help, showing special animation sequences for landing on certain Monopoly properties, showing attract mode sequences, showing special bonuses, etc.

The game of chance is essentially a roulette-type game based on Monopoly. The game pieces are Monopoly tokens occupying properties of the board. With four player terminals 16, 18, 20, and 22, there are preferably four Monopoly tokens on the board. Each Monopoly token is assigned to a respective player terminal. In response to a wager placed at one of the player terminals and pressing the PLAY/GO push-button (see FIG. 3), the token assigned to that terminal acts like a roulette ball and traverses the stationary Monopoly board several times before randomly landing on one of the Monopoly properties. Instead of sequencing moving around the properties of the Monopoly board, the token may rapidly "hop" between random properties until stopping on one of the properties.

The game allows each player to wager on individual properties or groups of properties with the odds similar to roulette. The groups of properties may, for to example, include color groups (i.e., proximate properties having the same color such as Boardwalk and Park Place), four railroads, two utilities, four corner properties, each of the four rows of the Monopoly board, Community Chest, Chance, etc. Community Chest and Chance may also be used to adjust the odds. For example, if the token lands on Community Chest or Chance, the visual display may depict a card drawn from the appropriate deck. Based on the instructions shown on the card, the game may award a bonus payoff, cause the player's token to move to a different property on the Monopoly board, or perform some other function. The token remains on the last property landed on until another wager is made by the same or a different player at the player terminal to which the token is assigned.

The wager placed at one player terminal is independent of any other wagers placed at the other player terminals and is independent of when the other wagers are placed. Similarly, the token assigned to one player terminal is independent of the tokens assigned to the other player terminals. Therefore, wagers may be placed at the respective player terminals at the same time or at different times, and tokens assigned to the respective player terminals may move around the Monopoly board at the same time or at different times.

A player may place wagers of varying amounts on multiple individual and/or groups of properties for each movement of his or her assigned token around the Monopoly board. The visual display 14 displays the wagers in such a way, i.e., using color-coded chips, that each player can wager on any property at any time and be able to distinguish his or her wager at one player terminal from any wagers placed at the other player terminals.

To wager on an individual property, the player uses the trackball 38 (see FIG. 3) to move a cursor assigned to his or her player terminal over an individual property. The cursor may be color coded, labeled, or specially shaped to facilitate association with the player terminal. The player then presses the BET 1 push-button (up to five times) or BET 5 push-button to wager up to five betting units that the token will land on that property.

To wager on a group of properties, the player uses the trackball 38 (see FIG. 3) to move the cursor over each property in the group and presses the SELECT push-button (see FIG. 3) when the cursor is over each property. After all the properties in the group have been selected, the player presses the BET 1 push-button (up to five times) or BET 5 push-button to wager up to five betting units that the token will land on one of the selected properties. To facilitate selection of groups of properties with an easily recognizable characteristic (e.g., same color, railroads, utilities, corners, row, Community Chest, Chance, etc.), the visual display 14 may include a list of these special groups. To wager on one of these special groups, the player uses the trackball 38 (see FIG. 3) to move the cursor over that special group in the list and then presses the BET 1 push-button (up to five times) or BET 5 push-button to wager up to five betting units that the token will land on that special group. Alternatively, the Monopoly board itself may have special group selection areas, icons, or symbols on the properties themselves which, when selected using the trackball and cursor, result in the selection of the group. For example, each railroad property may include an "ALL RAILROADS" icon that, when selected on one of the four railroads, results in the selection of all four railroads. Similarly, each property of a color groups may include an "ALL OF THIS COLOR" icon (or more specifically "ALL GREEN", "ALL BLUE", etc.) or colored rectangle that, when selected on one of the properties of a color group, results in the selection of all properties of that color group. Wagers placed on groups of properties on the Monopoly board are similar to wagers placed on fields of numbers in roulette.

The game awards a payoff to a player if his or her token lands on a property on which the player placed a wager. The amount of the payoff is generally based on the game's payback percentage, the odds of the randomly-moving token landing on that property, and whether the property was wagered on alone (higher payoff) or as part of a group (lower payoff). The payback percentage is the total percentage of each betting unit wagered on the game that is returned to players as payoffs over the long run. The odds of the token landing on each property is equal to one divided by the total number of properties which, in the case of a Monopoly board, is 1/40. If the payback percentage is close to 100 percent (e.g., 90 to 99 percent), then if the property was wagered on alone the payoff would be slightly less than forty betting units multiplied by the number of betting units wagered. Alternatively, if the property was wagered on as part of a group of four properties, for example, then the payoff would be slightly less than ten betting units (1/4×40) multiplied by the number of betting units wagered. A player can view a pay table including the payoffs for individual properties and different groups of properties by using the trackball 38 (see FIG. 3) to move the cursor over a menu item for the pay table and then pressing the SELECT push-button (see FIG. 3).

A player can preferably select the appearance of the token assigned to his or her player terminal. With respect to Monopoly, the token may be shaped like a dog, cannon, car, horse and rider, top hat, battleship, wheelbarrow, shoe, thimble, or iron. To select the appearance of the token, the player uses the trackball 38 (see FIG. 3) to move the cursor over the token and then presses the SELECT push-button (see FIG. 3) either to change the appearance of the token with each press of the SELECT push-button or to bring up a pop-up menu of token icons to choose from. Alternatively, the appearance of the token may be selected from a menu item in the same menu that allows the player to view the pay table.

Although the board game in FIG. 4 is based on Monopoly, the game board may alternatively be based on some other theme. Also, the multi-space trail of the game board may form a closed loop (as for Monopoly) of any shape or an open loop where the end of the trail is not connected to the beginning of the trail.

In another embodiment depicted in FIG. 5, the visual display 14 depicts a play field in the form of a craps table. The games pieces are pairs of animated dice where each pair of dice is assigned to a respective player terminal. The craps table is generally located in the center of the visual display 14. First remaining areas 46 of the visual display 14 outside the craps table and proximate to each player terminal may be used to display credits, bet, total bet, and paid information for each player. Second remaining areas 48 of the visual display 14 outside the craps table may then be separated into four distinct areas, one for each player terminal, which may be used to facilitate and enhance game play. For example, the second remaining areas 48 may be used for placement of certain types of bets, showing odds, displaying payoffs, showing help, showing special animation sequences for rolling certain number totals on the dice, showing attract mode sequences, showing special bonuses, etc.

The craps game on the visual display 14 is played like craps at a physical table except that each player terminal is assigned its own pair of dice. The dice are preferably coded in some way, such as by color, so that it is clear as to which pair of dice is assigned to each player terminal. With four player terminals 16, 18, 20, and 22, there are preferably four differently colored pairs of dice. The pair of animated dice assigned to a respective player terminal may be "rolled" either directly across the craps table or in the remaining area 48 associated with that terminal. Before the dice are rolled, wagers can be placed in the various fields of the craps table.

To wager on a field of the craps table, for example, a player may use the trackball 38 (see FIG. 3) to move a cursor assigned to his or her player terminal over a field of the craps table. The cursor may be color coded, labeled, or specially shaped to facilitate association with the player terminal. The player then presses the BET 1 push-button (up to five times) or BET 5 push-button to wager up to five betting units in that field. The player can wager on additional fields in the same manner. The visual display 14 may also include a list of the fields. To wager on one of these fields using the list, the player uses the trackball 38 (see FIG. 3) to move the cursor over that field in the list and then presses the BET 1 push-button (up to five times) or BET 5 push-button to wager up to five betting units in that field. To facilitate wagering the same amount in multiple fields of the craps table, the player may use the SELECT push-button to select the multiple fields and then use the BET 1 and BET 5 push-buttons to enter a common wager for the selected fields.

After a player makes a wager on one or more fields of the craps table, the player presses the PLAY push-button at his or her player terminal. In response, the pair of color-coded dice assigned to his or her player terminal are thrown virtually on the video display 14. Each die has six sides, where each side has a different number of spots from one to six. If the player is considered the "shooter," the player must place a "pass" wager or a "don't pass" wager in order to be eligible to roll the dice as the shooter. The total number of spots on the tops of the pair of dice after the shooter has rolled is called the "roll." A game consists of a series of rolls. A roll of 2, 3, or 12 is called "craps."

The first roll by the shooter during a game is called the "come-out roll." If the come-out roll is 7 or 11, the game is over and wagers are resolved as follows: wagers on the "pass line" win 1:1, and wagers on the "don't pass line" lose. If the come-out roll is craps, the game is over and wagers are resolved as follows: wagers on the "pass line" lose; and wagers on the "don't pass line" win unless the "don't pass line" says "bar" and the roll is the indicated value, in which case the wager pushes.

Otherwise, the come-out roll becomes the "point," and a large marker is placed on the number representing the point (4, 5, 6, 8, 9, or 10). For each roll in a game subsequent to the come-out roll, the game is played as follows. If the roll is the point, the game is over and wagers are resolved as follows: wagers on the "pass line" win 1:1, and wagers on the "don't pass line" lose. If the roll is 7, the game is over and wagers are resolved as follows: wagers on the "pass line" lose, wagers on the "don't pass line" win 1:1, and the turn of the shooter is over. If the roll is not a 7, the game continues and the shooter rolls again.

During a game, wagers on the "pass line" cannot be removed; they can, however, be increased. Wagers on the "don't pass line" may be decreased or removed, but not increased. If the game is over on the come-out roll, or because the point was rolled again, the shooter may continue to be the shooter for another game or pass the dice on to another "person" who becomes the new shooter. If the game is over for another other reason, the shooter must pass the dice on to another "person" who becomes the new shooter. In the context of the gaming platform of the present invention, this other person may be a computer-generated representation of a person on the video display 14. Alternatively, the game can be designed so that the player never passes the dice and is always the shooter.

Other wagers that can be made and resolved are not detailed above for purposes of clarity, but a description of such wagers can be obtained from a basic craps rule book or conventional craps game description.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of conducting a game of chance on a multi-player gaming platform, the platform including a visual display and a plurality of player terminals coupled to the visual display, the method comprising:

providing the game of chance with a single playfield and a plurality of game pieces proximate the playfield, the single playfield being depicted by the visual display;

assigning the game pieces to the respective player terminals;

receiving a wager at one of the player terminals without regard to when any wagers are received at the other player terminals;

randomly selecting a game outcome for the one of the player terminals by operating the game piece assigned to that player terminal without regard to when the game pieces assigned to the other player terminals are operated; and awarding a payout to the one of the player terminals if the game outcome meets winning criteria.

2. The method of claim 1, wherein the game outcome is defined by the game piece itself.

3. The method of claim 1, wherein the step of randomly selecting a game outcome includes moving the game piece assigned to the one of the player terminals relative to the playfield, the game outcome being defined by where the game piece lands on the playfield.

4. The method of claim 1, wherein the playfield is a multi-space trail and the game pieces are tokens, and wherein the step of randomly selecting a game outcome includes moving the token assigned to the one of the player terminals along spaces of the trail.

5. The method of claim 4, wherein the multi-space trail forms a closed loop where an end of the trail is connected to a beginning of the trail.

6. The method of claim 4, wherein the game outcome is defined by which space of the trail the token lands on.

7. The method of claim 6, wherein the step of moving the token along spaces of the trail includes moving the token sequentially along the spaces of the trail.

8. The method of claim 4, wherein the step of receiving a wager includes wagering on which of the spaces of the trail the token will land on.

9. The method of claim 1, wherein the game of chance is craps, the playfield is a craps table, and the game pieces are pairs of dice virtually thrown proximate the craps table.

10. The method of claim 1, wherein the visual display is a video display.

11. The method of claim 10, wherein the video display is selected from a group consisting of a CRT, LCD, and plasma display.

12. The method of claim 1, wherein each of the player terminals includes a respective interface panel.

13. The method of claim 1, wherein the step of randomly selecting a game outcome includes moving the game piece assigned to the one of the player terminals relative to the playfield without regard to when the game pieces assigned to the other player terminals are moved relative to the playfield.

14. A method of conducting a game of chance on a multi-player gaming platform, the platform including a visual display and a plurality of player terminals coupled to the visual display, the method comprising:

providing the game of chance with a single playfield and a plurality of game pieces assigned to the respective player terminals, the single playfield being depicted by the visual display;

receiving a wager at any of the player terminals without regard to when any wagers are received at the other player terminals;

conducting the game of chance on the playfield using the game piece assigned to any of the player terminals without regard to when the game of chance is conducted on the playfield using the game pieces assigned to the other respective player terminals, thereby allowing players at the respective player terminals to play the game of chance on the playfield independent of each other; and awarding a payout to any of the player terminals if the game of chance conducted for that player terminal generates a winning outcome.

15. A method of allowing multiple players to independently play a game of chance on a common playfield, comprising:

providing a multi-player gaming platform including a visual display and a plurality of player terminals coupled to the visual display, the common playfield being depicted by the visual display;

assigning a plurality of game pieces to the respective player terminals;

receiving a wager at any of the player terminals without regard to when any wagers are received at the other player terminals;

conducting the game of chance on the playfield using the game piece assigned to any of the player terminals without regard to when the game of chance is conducted on the playfield using the game pieces assigned to the other respective player terminals; and awarding a payout to any of the player terminals if the game of chance conducted for that player terminal generates a winning outcome.

* * * * *